US006527924B1

(12) United States Patent
Andolfatto et al.

(10) Patent No.: US 6,527,924 B1
(45) **Date of Patent: *Mar. 4, 2003**

(54) CATHODE FOR ELECTROLYZING AQUEOUS SOLUTIONS

(75) Inventors: Françoise Andolfatto, Lyons (FR); Philippe Joubert, Lyons (FR)

(73) Assignee: Atofina, Puteaux (FR)

( * ) Notice: Subject to any disclaimer, the term of this patent is extended or adjusted under 35 U.S.C. 154(b) by 12 days.

This patent is subject to a terminal disclaimer.

(21) Appl. No.: 09/807,915

(22) PCT Filed: Aug. 18, 2000

(86) PCT No.: PCT/FR00/02341

§ 371 (c)(1),
(2), (4) Date: Apr. 20, 2001

(87) PCT Pub. No.: WO01/14615

PCT Pub. Date: Mar. 1, 2001

(30) Foreign Application Priority Data

Aug. 20, 1999 (FR) ..... 99 10659

(51) Int. Cl.[7] ..... C25B 11/00

(52) U.S. Cl. ..... 204/290.01; 204/290.11; 204/290.12; 204/290.13; 204/290.14

(58) Field of Search ..... 204/290.12, 290.13, 204/290.14, 290.11, 290.01

(56) References Cited

U.S. PATENT DOCUMENTS

| | | | | |
|---|---|---|---|---|
| 4,530,742 | A | 7/1985 | Carlin | |
| 6,352,625 | B1 * | 3/2002 | Andolfatto et al. .... | 204/290.12 |

FOREIGN PATENT DOCUMENTS

| | | |
|---|---|---|
| FR | 2775486 | 9/1999 |
| WO | 86/06108 | 10/1986 |

* cited by examiner

*Primary Examiner*—Arun S. Phasge
(74) *Attorney, Agent, or Firm*—Millen, White, Zelano & Branigan, P.C.

(57) ABSTRACT

A cathode comprising an electrically conductive substrate made of titanium, nickel, tantalum, zirconium, niobium, iron or alloys thereof, coated with an intermediate layer of oxides of titanium and of a precious metal, and with an outer layer comprising metal oxides of titanium, zirconium and a precious metal, can be used for the electrolysis of solutions, in particular for the electrolysis of aqueous solutions of alkali metal chlorides.

20 Claims, No Drawings

CATHODE FOR ELECTROLYZING AQUEOUS SOLUTIONS

The present invention relates to a cathode which can be used for the electrolysis of aqueous solutions in which a water-reduction reaction takes place.

More particularly, the present invention relates to an activated cathode which can be used for the electrolysis of alkaline aqueous solutions of alkali metal chlorides, and most particularly for the preparation of chlorine and sodium hydroxide.

Thus, chlorine and sodium hydroxide are manufactured industrially in electrolytic cells, each of these cells comprising several mild steel cathodes and several titanium anodes coated with a mixture of titanium oxide and ruthenium oxide. They are generally fed in an electrolytic solution consisting of about 200 to 300 g/l of sodium chloride.

However, these mild steel cathodes have a relatively high overvoltage in absolute value terms as water-reducing cathodes and also have an insufficient resistance to corrosion by dissolved chlorine.

The term "overvoltage" means the difference between the thermodynamic potential of the redox couple concerned ($H_2O/H_2$) relative to a reference cathode and the potential effectively measured in the medium concerned, relative to the same reference electrode. By convention, the term overvoltage will be used to denote the absolute value of the cathode overvoltage.

Many cathodes have been proposed to overcome these drawbacks.

Thus, French patent application FR 2 311 108 discloses a cathode whose substrate is a plate made of titanium, zirconium, niobium or of an alloy essentially consisting of a combination of these metals, and on which is applied a layer of metal oxide, consisting essentially of an oxide of one or more metals chosen from ruthenium, rhodium, palladium, osmium, iridium and platinum and optionally an oxide of one or more metals chosen from calcium, magnesium, strontium, barium, zinc, chromium, molybdenum, tungsten, selenium and tellurium.

U.S. Pat. No. 4,100,049 describes a cathode comprising a substrate made of iron, nickel, cobalt or an alloy of these metals and a coating of palladium oxide and zirconium oxide.

European patent application EP 209 427 discloses a cathode consisting of an electrically conductive substrate made of nickel, stainless steel or mild steel bearing a coating consisting of a plurality of metal oxide layers, the surface layer consisting of an oxide of a valve metal, i.e. a metal chosen from groups 4*b*, 5*b* and 6*b* of the Periodic Table of the Elements, and the intermediate layer consisting of an oxide of a precious metal from group VIII, i.e. ruthenium, rhodium, palladium, osmium, iridium and platinum.

The intermediate and surface layers can consist of the oxide of the single metal concerned or of a mixed oxide of the metal concerned and of the second metal in small proportion.

Although these cathodes have a satisfactory overvoltage, the Applicant has observed, during the evaluation of the said cathodes, a modification of the polarization curve after the first sweep, revealing damage to the surface layer, which is detrimental to correct protection of the substrate and thus results in a limited lifetime of the said electrodes.

A cathode has now been found which can reduce the overvoltage of the water-reducing reaction in alkaline medium, characterized in that it consists of an electrically conductive substrate coated with an intermediate layer of oxides based on titanium and on a precious metal from group VIII of the Periodic Table of the Elements and with an outer layer of metal oxides comprising titanium, zirconium and a precious metal from group VIII of the Periodic Table of the Elements.

The expression "precious metal from group VIII of the Periodic Table of the Elements" means, in the present text, ruthenium, rhodium, palladium, osmium, iridium or platinum. Ruthenium or iridium will preferably be used, and most particularly ruthenium.

The intermediate layer advantageously contains titanium oxide and ruthenium oxide.

The outer layer of metal oxides preferably contains titanium oxide, zirconium oxide and ruthenium oxide.

Better still, the outer layer consists essentially of $ZrTiO_4$ accompanied by $RuO_2$ and optionally $ZrO_2$ and/or $TiO_2$.

The material of which the substrate is made can be chosen from electrically conductive materials. It will be chosen advantageously from the group consisting of titanium, nickel, tantalum, zirconium, niobium, iron and alloys thereof.

Titanium, nickel, iron or alloys thereof will preferably be chosen.

The precious metal/titanium molar ratio in the intermediate layer is preferably between 0.4 and 2.4.

The zirconium/titanium molar ratio in the outer layer is generally between 0.25 and 9 and preferably between 0.5 and 2.

The precious metal in the outer layer is at least equal to 10 mol %, preferably between 30 mol % and 50 mol %, relative the metals forming part of the composition of this layer.

The cathode according to the present invention can be prepared according to a process which consists in carrying out the following steps:

a) pretreating a substrate to give it surface-roughness properties, b) coating the pretreated substrate using a solution A essentially containing titanium and a precious metal, followed by drying and then calcination of the substrate thus coated, c) coating the substrate obtained in b) using a solution B comprising titanium, zirconium and a precious metal, followed by drying and calcination of the substrate thus coated.

The pretreatment generally consists in subjecting the substrate, either to a sanding operation optionally followed by washing with acid, or to a stripping operation using an aqueous solution of oxalic acid, hydrofluoric acid, a mixture of hydrofluoric acid and nitric acid, a mixture of hydrofluoric acid and glycerol, a mixture of hydrofluoric acid, nitric acid and glycerol or a mixture of hydrofluoric acid, nitric acid and hydrogen peroxide, followed by one or more washes with degassed demineralized water.

The substrate can be in the form of a solid plate, a perforated plate, expanded metal or a cathode basket consisting of expanded or perforated metal.

Solution A is generally prepared by placing in contact, at room temperature and with stirring, essentially a mineral salt or organic salt of titanium and of a precious metal with water or in an organic solvent, optionally in the presence of a chelating agent. The temperature can be raised above room temperature to help the salts to dissolve.

Advantageously, a mineral salt or organic salt of titanium and of a precious metal is placed in contact with water or in an organic solvent, optionally in the present of a chelating agent.

The titanium and the precious metal are preferably present in solution A at a concentration of not more than 10 mol/l.

Solution B is generally prepared by placing in contact, at room temperature and with stirring, a mineral salt or organic salt of titanium, of zirconium and of a precious metal with water or in an organic solvent, optionally in the presence of a chelating agent. When the placing in contact is exothermic, a bath of ice is used to cool the reaction medium.

Advantageously, a mineral salt or organic salt of titanium, of zirconium and of a precious metal is placed in contact with water or in an organic solvent, optionally in the presence of a chelating agent.

The preferred titanium and precious metal salts are the chlorides, oxychlorides, nitrates, oxynitrates, sulphates and alkoxides. The chlorides of precious metals, ruthenium chlorides, titanium chlorides and titanium oxychlorides are advantageously used.

Zirconium salts which can be used are the chlorides and sulphates, zirconyl chloride, zirconyl nitrate and alkoxides such as butyl zirconate.

Zirconyl and zirconium chlorides are particularly preferred.

Organic solvents which may be mentioned are light alcohols, preferably isopropanol and ethanol, and better still isopropanol and absolute ethanol.

Although it is possible, indifferently, to use water or an organic solvent to prepare solution B, it is nevertheless preferred to use an organic solvent when the metal salts are solid at room temperature.

Thus, when the metal salt is zirconium chloride, absolute ethanol or absolute isopropanol is used as solvent.

Titanium and zirconium are generally present in solution B at a concentration ranging from 0.5 to 5 mol/l. The concentration of precious metal in solution B is generally between 0.05 and 10 mol/l and preferably between 0.1 and 5 mol/l.

Solution A can be deposited on the pretreated substrate using various techniques such as sol-gel, electroplating, galvanic electroplating, spraying or coating. The pretreated substrate is advantageously coated with solution A, for example using a brush. The substrate thus coated is then air-dried and/or dried in an oven at a temperature below 150° C. After drying, the substrate is calcined in air or under inert gases such as nitrogen or argon or alternatively under oxygen-enriched inert gases at a temperature at least equal to 300° C. and preferably between 450° C. and 550° C., for a period ranging from 10 minutes to 2 hours.

For step c) of the process, the same deposition techniques and the same drying and calcination operating conditions as in step b) can be used, except that the deposition is carried out with solution B.

Other techniques such as chemical vapour deposition (CVD), physical vapour deposition (PVD) or plasma spraying are also suitable for coating the pretreated substrate with an intermediate layer and an outer layer.

Solution A can be deposited either on one of the sides of the pretreated substrate or on both sides. Solution B can also be deposited on both sides of the substrate coated with the intermediate layer.

Depending on the desired thickness of the intermediate layer, step b) of the process can be repeated several times. Similarly, step c) of the process can be repeated several times.

In the intermediate layer, the mass of product deposited is at least equal to 2 g/m$^2$, generally between 10 g/m$^2$ and 60 g/m$^2$ and preferably between 20 g/m$^2$ and 35 g/m$^2$, relative to the geometrical area of the substrate.

The concentration of solution A is judiciously chosen such that this preferred deposited mass can be obtained by repeating step b) a reasonable number of times and preferably between 1 and 10 times.

In the outer layer, the mass of product deposited is at least equal to 5 g/m$^2$, generally between 5 g/m$^2$ and 70 g/m$^2$ and preferably between 25 g/m$^2$ and 50 g/m$^2$ relative to the geometrical area of the substrate. Solution B is generally prepared such that its concentration makes it possible to obtain a preferred deposited mass by repeating step (c) at least once and preferably between 2 and 10 times.

The cathode of the present invention is most particularly suitable for the electrolysis of aqueous solutions of alkali metal chlorides and in particular of aqueous NaCl solutions.

The use of the cathode in combination with an anode allows the electrolytic synthesis of chlorine and the alkali metal hydroxide in a high Faraday yield.

Anodes which may be mentioned are DSA anodes (Dimensionally Stable Anodes) consisting of a titanium substrate coated with a layer of titanium oxide and ruthenium oxide. The ruthenium/titanium molar ratio in this layer is advantageously between 0.4 and 2.4.

The cathode of the present invention has the advantage of having a lower overvoltage than the cathodes of the prior art during electrolysis functioning.

In addition, the cathode of the present invention does not undergo any change from the very first characterization cycles and shows greater chemical stability with respect to corrosive alkaline media.

The examples which follow illustrate the invention without limiting it.

EXAMPLES

1. Preparation of a Cathode (in Accordance with the Invention)

1.1 Pretreatment and Deposition of the Intermediate Layer

A titanium plate 2 mm thick and 4 cm×1 cm in size, to which has been welded a round rod for supplying current, is sanded with corundum particles.

A solution A containing ruthenium and titanium in equimolar amount is then prepared by mixing together at room temperature, with stirring, 2.45 g of $RuCl_3$, with a purity of greater than or equal to 98%, 3.64 cm$^3$ of $TiOCl_2.2HCl$ containing 127 g/l of Ti and 2.5 cm$^3$ of absolute isopropanol.

The end of one of the sides of the pretreated plate, representing an area of 1 cm×4 cm, is then coated with solution A using a brush, after which it is allowed to dry for 30 minutes in the open air and at room temperature. The coated plate is then further dried in an oven at 120° C. for 30 minutes, after which it is calcined in an oven under air at 500° C. for 30 min.

These operations (coating, drying and calcination) are repeated twice more and, at the end of these three coatings, the mass of ruthenium oxide and titanium oxide deposited is equal to 18 g/m$^2$ relative to the geometrical area of the plate.

1.2 Deposition of the Outer Layer

General Procedure

Zirconium chloride or oxychloride, ruthenium chloride and titanium chloride or oxychloride are mixed with absolute ethanol, with stirring. In the case of the chlorides, solution B is prepared under cold conditions and kept cold by a water/ice bath, with stirring, until it is used.

In the case of the oxychlorides, solution B is prepared at 60° C. and kept at this temperature, with stirring, until it is used.

The plate coated in step 1.1 is then coated with solution B using a brush. In a first stage, the coated plate is dried for 30 minutes in the open air and at room temperature, and then, in a second stage, further dried in an oven at 120° C. for 30 minutes, and finally calcined in an oven under air at 500° C. for 30 minutes.

These operations (coating, drying and calcination) are repeated several times until a deposited mass of oxides ranging from 30 g/m$^2$ to 45 g/m$^2$, relative to the geometrical area of the plate, is obtained.

2. Evaluation of the Cathode—Procedure

The performance qualities of the cathode, with respect to the reduction of water, are evaluated from a polarization curve, produced in a 1M NaOH solution and at a temperature of between 20° C. and 25° C. (room temperature).

The term "polarization curve" means the curve of the variation in cathodic potential measured relative to a reference electrode, for example a saturated calomel electrode (SCE), as a function of the current density.

The experimental assembly consists of the cathode to be evaluated, a platinum counter-electrode (area 5 cm$^2$) and a reference SCE electrode extended by a capillary, which is placed in immediate proximity to the cathode.

The assembly is immersed in the electrolytic solution (1M NaOH) stirred by means of a magnetic stirrer.

The three electrodes are connected to the terminals of a potentiostat. The cathode potential is set by the apparatus and the value of the current passing through the system is read after the said system has reached equilibrium.

This potential is varied from −0 mV/SCE to −1500 mV/SCE.

Example 1 (According to the Invention)

Solution B is prepared by mixing together, with stirring, in a glass flask, 1.07 g of $RuCl_3$, 2.59 g of $ZrOCl_2.8H_2O$, 1.55 ml of $TiOCl_2.2HCl$ in 7 ml of absolute ethanol, i.e. an overall molar composition of 0.3 Ru-0.7 (Ti, 2Zr).

The plate coated with the intermediate layer is then coated with solution B thus prepared, after which it is dried and calcined in air as indicated in the general procedure. These operations are repeated 8 times and, after the final calcination, the deposited mass is 39 g/m$^2$, relative to the geometrical area of the plate.

The cathode thus prepared was evaluated using the procedure described previously. The cathode potential is −1.375 V/SCE for a current density of −2 kA/m$^2$.

For comparative purposes, the cathode potential of a nickel cathode is −1.475 V/SCE under the same conditions.

Example 2 (According to the Invention)

Solution B is prepared by mixing together, with stirring, in a glass flask, 2.49 g of $RuCl_3$, 2.59 g of $ZrOCl_2.8H_2O$, 1.55 ml of $TiOCl_2.2HCl$ in 10 ml of absolute ethanol, i.e. an overall molar composition of 0.5 Ru-0.5 (Ti, 2Zr).

The plate coated with the intermediate layer is then coated with solution B thus prepared, after which it is dried and calcined in air as indicated in the general procedure. These operations are repeated 8 times and, after the final calcination, the external mass deposited is 41 g/m$^2$, relative to the geometrical area of the plate.

The cathode thus prepared was evaluated using the procedure described previously. The cathode potential is −1.195 V/SCE for a current density of −2 kA/m$^2$.

Example 3 (According to the Invention)

Solution B is prepared by mixing together, with stirring, in a glass container cooled using an ice bath, 2.49 g of $RuCl_3$, 2.80 g of $ZrCl_4$ and 1.32 ml of $TiCl_4$ in 10 ml of absolute ethanol, i.e. an overall molar composition of 0.5 Ru-0.5 (Ti, Zr).

The plate coated with the intermediate layer is then coated with solution B thus prepared, after which it is dried and calcined in air as indicated in the general procedure. These operations are repeated 8 times and, after the final calcination, the mass deposited is 45 g/m$^2$, relative to the geometrical area of the plate.

The cathode thus prepared was evaluated using the procedure described previously. The cathode potential is −1.190 V/SCE for a current density of −2 kA/m$^2$ in a 1M NaOH solution.

Example 4 (Not in Accordance with the Invention)

A cathode is prepared according to patent application EP 209 427 and its evaluation is carried out.

The substrate consists of a 4×1×0.2 cm plate to which has been welded a round rod for supplying current. A surface treatment is carried out using corundum.

A solution of 2 g of $RuCl_3$ in 2 ml of ethanol is prepared at room temperature. The control plate is coated using this solution. Next, the plate is air-dried at 120° C. for 30 minutes, followed by calcination under air (500° C., 30 minutes). A 16 mg/m$^2$ deposit of $RuO_2$ is obtained.

A solution of 2.6 ml of $TiOCl_2.HCl$, containing 2.5 mol/l of Ti, in 2 cm$^3$ of ethanol is prepared at room temperature. The same coating/oven-drying/calcination in air treatments are carried out. 8.5 g/m$^2$ of $TiO_2$ are thus deposited.

The cathode potential of this electrode is −1.240 V/SCE for a current density of −2 kA/m$^2$ evaluated according to the procedure described previously.

Although this potential is satisfactory, a large modification of the polarization curve after the first sweep and the appearance of solid particles in the solution are, however, observed, which is characteristic of a modification of the surface layer and of damage thereto, which is unsatisfactory for the long-term use of this cathode.

What is claimed is:

1. A cathode for the electrolysis of aqueous solutions, comprising an electrically conductive substrate coated with an intermediate layer comprising oxides of titanium and of a precious metal from group VIII of the Periodic Table of the Elements, and with an outer layer comprising metal oxides of titanium, zirconium and a precious metal from group VIII of the Periodic Table of the Elements.

2. A cathode according to claim 1, wherein the substrate comprises a metal chosen from the group consisting of titanium, nickel, tantalum, zirconium, niobium, iron and alloys thereof.

3. A cathode according to claim 2, wherein the substrate comprises titanium, iron or nickel.

4. A cathode according to claim 3, wherein the intermediate layer comprises titanium oxide and ruthenium oxide.

5. A cathode according to claim 4, wherein the outer layer consists essentially of $ZrTiO_4$, $RuO_2$, and optionally $ZrO_2$ and/or $TiO_2$.

6. A cathode according to claim 5, having a precious metal/titanium molar ratio in the intermediate layer of between 0.4 and 2.4.

7. A cathode according to claim 6, having a zirconium/titanium molar ratio in the outer layer of between 0.5 and 2.

8. A cathode according to claim 1, wherein the precious metal from group VIII of the Periodic Table of the Elements comprises ruthenium, rhodium, palladium, osmium, iridium or platinum.

9. A cathode according to claim 1, wherein the precious metal comprises ruthenium or iridium.

10. A cathode according to claim 1, wherein the intermediate layer comprises titanium oxide and ruthenium oxide.

11. A cathode according to claim 1, wherein the outer layer of metal oxides contains zirconium oxide, titanium oxide and ruthenium oxide.

12. A cathode according to claim 11, wherein the outer layer consists essentially of $ZrTiO_4$, $RuO_2$, and optionally $ZrO_2$ and/or $TiO_2$.

13. A cathode according to claim 1, having a precious metal/titanium molar ratio in the intermediate layer of between 0.4 and 2.4.

14. A cathode according to claim 1, having a zirconium/titanium molar ratio in the outer layer of between 0.25 and 9.

15. A cathode according to claim 14, having a zirconium/titanium molar ratio in the outer layer of between 0.5 and 2.

16. A cathode according to claim 1, wherein the precious metal in the outer layer is at least equal to 10 mol % relative to the metals forming part of the composition of said outer layer.

17. A cathode according to claim 16, wherein the precious metal in the outer layer represents a molar amount of between 30% and 50% relative to the metals forming part of the composition of said outer layer.

18. In a process comprising electrolysising an aqueous solution of an alkali metal chloride in an electrolytic cell comprising a cathode, the improvement wherein the cathode is according to claim 1.

19. A process according to claim 18, wherein the aqueous solution of an alkali metal chloride comprises an aqueous NaCl solution.

20. In a process comprising producing chlorine and alkali metal hydroxide by electrolysis of the corresponding chloride, the improvement comprising conducting the electrolysis in an electrolytic cell comprising a cathode according to claim 1.

* * * * *